US007470141B2

(12) United States Patent
Yoest

(10) Patent No.: US 7,470,141 B2
(45) Date of Patent: Dec. 30, 2008

(54) POWER CORD PLUG SECURING DEVICE

(76) Inventor: Daniel T. Yoest, 1525 Mt. McKinney Dr., Grayson, GA (US) 30017

( * ) Notice: Subject to any disclaimer, the term of this patent is extended or adjusted under 35 U.S.C. 154(b) by 276 days.

(21) Appl. No.: 10/644,138

(22) Filed: Aug. 20, 2003

(65) Prior Publication Data

US 2004/0166718 A1 Aug. 26, 2004

Related U.S. Application Data

(60) Provisional application No. 60/444,328, filed on Jan. 31, 2003.

(51) Int. Cl.
*H01R 13/62* (2006.01)

(52) U.S. Cl. ..... 439/369; 439/373

(58) Field of Classification Search ..... 439/369, 439/373, 371, 370, 342; 174/66, 53, 67, 174/135; 248/60, 62

See application file for complete search history.

(56) References Cited

U.S. PATENT DOCUMENTS

| | | | | |
|---|---|---|---|---|
| 2,569,037 | A | | 9/1951 | Dalton |
| 2,659,059 | A | | 11/1953 | Johnson |
| 2,675,530 | A | | 4/1954 | Sadasky |
| 2,722,665 | A | | 4/1954 | Sauder |
| 3,102,922 | A | | 9/1963 | Lashmutt |
| 3,811,104 | A | | 5/1974 | Caldwell |
| 3,888,439 | A | * | 6/1975 | Tuttle ..... 248/62 |
| 3,955,870 | A | | 5/1976 | Wasserman |
| 4,105,274 | A | | 8/1978 | Casey |
| 4,440,465 | A | * | 4/1984 | Elliott et al. ..... 439/369 |
| 4,484,185 | A | * | 11/1984 | Graves ..... 439/371 |
| 4,789,353 | A | | 12/1988 | Busta et al. |
| 5,011,427 | A | | 4/1991 | Martin |
| 5,044,976 | A | | 9/1991 | Thompson |
| 5,145,399 | A | | 9/1992 | Davenport |
| 5,211,573 | A | * | 5/1993 | Cross ..... 439/369 |
| 5,255,866 | A | | 10/1993 | Campolo |
| 5,348,495 | A | | 9/1994 | Kasden |
| 5,547,390 | A | | 8/1996 | Laherty |
| 5,573,420 | A | * | 11/1996 | Grosswendt ..... 439/371 |
| 5,291,043 | A | | 1/1997 | Kenney |
| 5,591,043 | A | * | 1/1997 | Kenney ..... 439/373 |
| 6,033,251 | A | * | 3/2000 | Cook ..... 439/369 |
| 6,071,142 | A | | 6/2000 | Blackman |

* cited by examiner

*Primary Examiner*—Felix O Figueroa
(74) *Attorney, Agent, or Firm*—Myers & Kaplan, LLC; Barry E. Kaplan

(57) ABSTRACT

A power cord plug securing device for securably maintaining a power cord plug in electrically operative engagement with an electrical outlet and/or electrical extension cord, thereby eliminating forced disengagement of same, and the resulting structural and functional damage to the power cord, plug head, and electrical outlet.

23 Claims, 9 Drawing Sheets

POWER CORD PLUG SECURING DEVICE

CROSS-REFERENCE AND PRIORITY CLAIM TO RELATED APPLICATIONS

To the fullest extent permitted by law, the present non-provisional application claims priority to and the benefit of provisional patent application entitled "Power Cord Plug Securing Device", filed on Jan. 31, 2003, having assigned Ser. No. 60/444,328.

TECHNICAL FIELD

The present invention relates, generally, to power cord accessories, and, more specifically, to a power cord plug securing device. The present invention is particularly suitable for, although not strictly limited to, securely maintaining a power cord plug in electrically operative engagement with an electrical outlet.

BACKGROUND OF THE INVENTION

Although necessary for the conveyance of electrical power to most electrical appliances and machinery, a common power cord, and the associated plug head, can often present a multitude of inconveniences, and pose potentially hazardous conditions, when engaged with an electrical outlet.

Specifically, an outlet-engaged power cord traversing a main walkway, such as a hallway, or the like, can easily become snarled or entangled around the legs of an inattentive passerby; thus, causing the forceful dislodgement of the plug head from the electrical outlet. Forced removal of the plug head from the outlet in such a manner bears obvious ramifications, including damage to the plug prongs, unsheathing of the insulative wire covering proximal the plug head, and/or damage to the internal components of the outlet socket itself. Such damage, thereby, increases the risk of electrical shock and circuit shortage.

Utilization of electrical extension cords, for purposes of electrically engaging corded appliances or machines with inconveniently located or distant electrical outlets, present separate complications. In particular, as appliance power cords and extension cords, in general, possess a finite length, the female plug head of an extension cord can become easily disengaged from the male plug head of the corded appliance when the appliance is being moved about, such as in the case of a vacuum cleaner, or any electrically-powered garden tool. The obvious result of such power cord-extension cord disengagement is the immediate cessation of electrical power to the appliance; thereby, burdensomely requiring the operator of same to reengage the appliance power cord to the extension cord for continued appliance operation.

Although plug removal prevention devices are known, such available devices possess clear disadvantages and limited functionality that make their use impractical, problematic, and even aesthetically displeasing due to their bulky and conspicuous appearance. For instance, U.S. Pat. No. 3,811,104 to Caldwell and U.S. Pat. No. 4,105,274 to Casey both disclose safety devices for retaining plugs in electrical outlets, wherein the devices are generally rigid bracket-like members that protrude substantially from the outlet cover plate. Although the devices of Caldwell '104 and Casey '274 may retain a plug within an outlet, the power cord is subject to being easily removed from the generally U-shaped retaining troughs disclosed in both patents; thus, permitting the plug head to be jostled about, and potentially removed from the outlet should enough force be applied thereto. Additionally, neither Caldwell '104 nor Casey '274 disclose devices capable of securely maintaining engagement of the female plug head of an extension cord to the male plug head of a corded appliance.

U.S. Pat. No. 5,044,976 to Thompson discloses an electrical cord holding device that possesses a rigid first portion of a hook-and-loop fastening mechanism that protrudes from, and is secured to, a cover plate, and a reciprocal second portion of a hook-and-loop fastening mechanism that is clamped onto a power cord, wherein the first and second portions of the hook-and-loop fastening mechanism are engageable to assist in retaining a plug within an outlet. As hook-and-loop fastening mechanisms are inherently removably affixable, however, little force is required to remove the plug from an outlet if utilizing the Thompson '976 device. Moreover, as is consistent with the prior art, Thompson '976 also fails to disclose a device capable of securely maintaining engagement of the female plug head of an extension cord to the male plug head of a corded appliance.

U.S. Pat. No. 5,348,495 to Kasden discloses an electrical cord plug lock assembly that requires the application of a special electrical outlet cover plate that possesses locking brackets adapted to receive a clamp-like member secured to the power cord via bolts. Not only is the Kasden '495 device unduly burdensome and complex to apply, it requires the removal of an existing cover plate for application of a special cover plate, a seemingly unnecessary cost and inconvenience to the consumer. Additionally, Kasden '495 also fails to disclose a device capable of securely maintaining engagement of the female plug head of an extension cord to the male plug head of a corded appliance.

U.S. Pat. No. 5,547,390 to Laherty also discloses an electrical plug securing device that requires the power cord to be intertwined between a series of retaining slots, an unnecessarily burdensome task, that hinders quick removal of the plug when desired. Additionally, the Laherty '390 device is, in large part, an aesthetically displeasing device that undesirably draws attention to an otherwise inconspicuous electrical outlet. Furthermore, Laherty '390 also fails to disclose a device capable of securely maintaining engagement of the female plug head of an extension cord to the male plug head of a corded appliance.

U.S. Pat. No. 5,591,043 to Kenney discloses an electrical cord holding device that is applied over, and fully superimposes, an electrical outlet, wherein wing-like flaps that protrude outwardly therefrom are folded inwardly, and a plug cord held therebetween via sliding the cord into retaining slots formed on the flaps. However, application of a sufficient pulling force would seemingly cause disengagement of the power cord from the outlet. Moreover, as with the aforementioned prior art, the Kenney '043 device is conspicuously aesthetically displeasing, and further fails to disclose a device capable of securely maintaining engagement of the female plug head of an extension cord to the male plug head of a corded appliance.

U.S. Pat. No. 6,071,142 to Blackman also discloses a device for preventing plug removal from a wall outlet, wherein the device utilizes suction-cups to maintain the plug within the outlet. As is common with any suction cup mechanism, however, the suctions cups of the Blackman '142 device are only capable of withstanding a threshold amount of pulling force before they become disengaged from the surface in which they were attached. Additionally, should the wall surface surrounding the outlet cover plate be substantially porous or possess a texture that does not permit airtight sealing of suction cups thereto, the Blackman '142 device becomes ineffectual and impractical. Furthermore, as with the aforementioned prior art, Blackman '142 similarly fails to disclose a device capable of securely maintaining engagement of the female plug head of an extension cord to the male plug head of a corded appliance.

Therefore, it is readily apparent that there is a need for a power cord plug securing device for securely maintaining a power cord plug in electrically operative engagement with an electrical outlet and/or electrical extension cord, wherein the device can be easily applied to a pre-existing electrical outlet plate with minimal effort.

BRIEF SUMMARY OF THE INVENTION

Briefly described, in a preferred embodiment, the present invention overcomes the above-mentioned disadvantages and meets the recognized need for such a device by providing a power cord plug securing device for securely maintaining a power cord plug in electrically operative engagement with an electrical outlet and/or electrical extension cord; thereby, eliminating forced disengagement of same, and the resulting structural and functional damage to the power cord, plug head, and electrical outlet.

According to its major aspects and broadly stated, the present invention in its preferred form is a power cord plug securing device having a securing strap and clasp member.

More specifically, the present invention, in its preferred form, is a power cord plug securing device having a securing strap integrally formed with a substantially U-shaped clasp member. The securing strap preferably possesses a throughhole for receipt of a conventional electrical outlet plate screw for fastening the securing strap to the face of the outlet plate, wherein the throughhole is preferably located on the securing strap at an end opposite of the clasp member. The clasp member is adapted to engage and securely retain the portion of power cord located immediately aft of a plug head; thus, preventing accidental or forced removal of an electrically engaged plug head from an electrical outlet socket.

The present invention in an alternate form provides a power cord plug securing device having a securing strap integrally formed with two opposingly positioned clasp members, wherein application of such a device enables the sustained engagement of a female plug head to a male plug head; thus, precluding accidental disconnection of same.

The present invention in another alternate form provides a power cord plug securing device having a securing strap integrally formed with two opposingly positioned clasp members. The securing strap preferably possesses a centrally disposed throughhole for receipt of a conventional electrical outlet plate screw for fastening the securing strap to the face of the outlet plate. Each clasp member is adapted to engage and securely retain the portion of power cord located immediately aft of a plug head; thus, enabling the sustained engagement of two plug heads with a conventional dual-socket electrical outlet.

Accordingly, a feature and advantage of the present invention is its ability to prevent accidental or forced removal of a plug head from an electrical outlet socket.

A feature and advantage of the present invention is its ability to enable the sustained engagement of a female plug head to a male plug head.

A feature and advantage of the present invention is its ability to enable the sustained engagement of two plug heads with a conventional dual-socket electrical outlet.

A feature and advantage of the present invention is its ability to prevent accidental or forced removal of a plug head from an electrical outlet socket; thus, reducing, or eliminating, damage to the plug prongs, unsheathing of the insulative wire covering proximal/aft the plug head, and/or damage to the internal components of the outlet socket itself; and, thereby, significantly reducing the risk of electrical shock and/or circuit shortage typically associated therewith.

These and other features and advantages of the present invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Alternate Embodiments with reference to the accompanying drawing Figures, in which like reference numerals denote similar structures and refer to like elements throughout, and in which.

DETAILED DESCRIPTION OF THE PREFERRED AND ALTERNATIVE EMBODIMENTS

In describing the preferred and representative alternate embodiments of the present invention, as illustrated in FIGS. 1-6, specific terminology is employed for the sake of clarity. The invention, however, is not intended to be limited to the specific terminology so selected, and it is to be understood that each specific element includes all technical equivalents that operate in a similar manner to accomplish similar functions.

Figure 1:
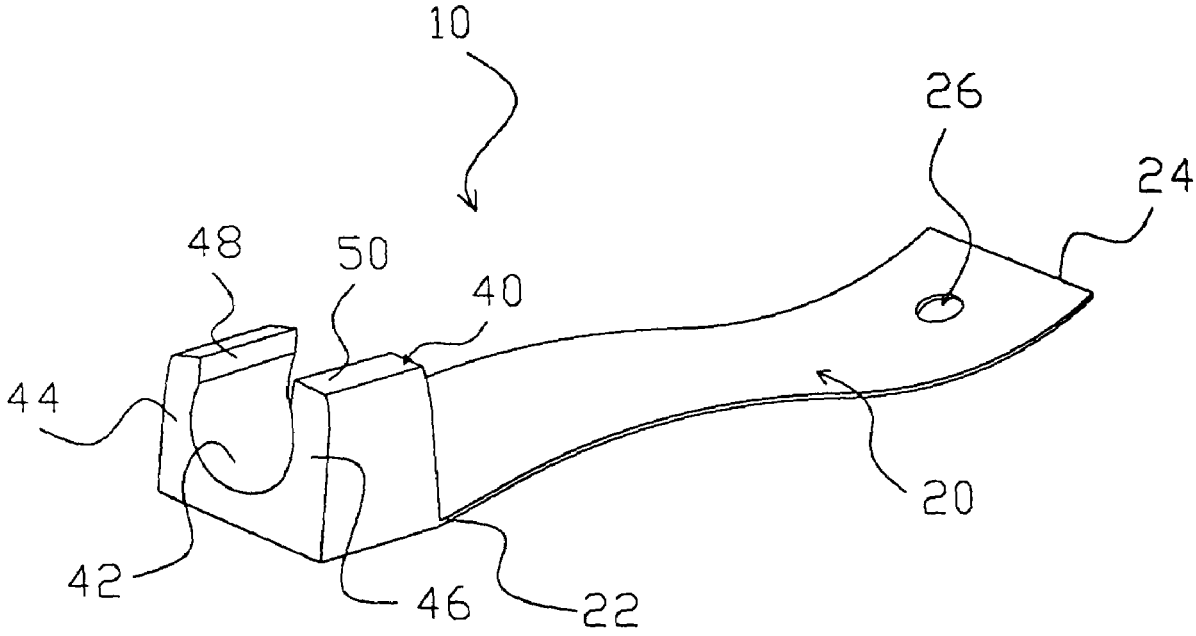
FIG. 1 is a perspective view of a power cord plug securing device according to a preferred embodiment of the present invention.
Figure 2:
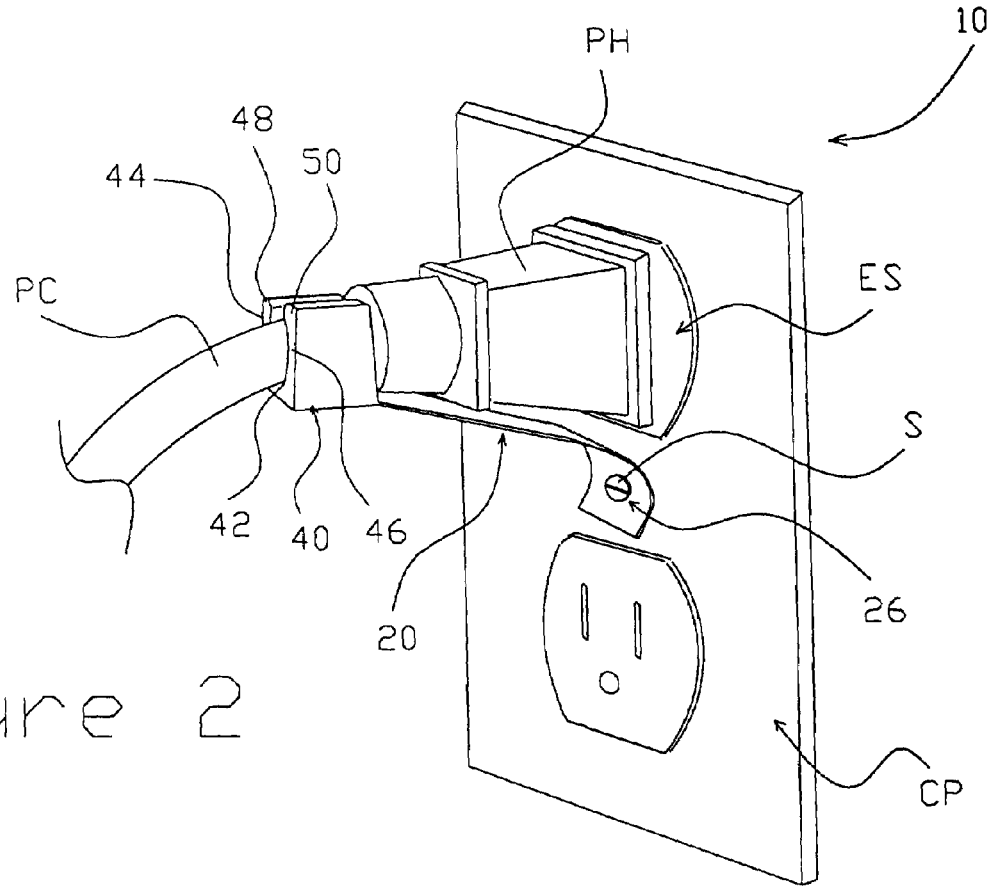
FIG. 2 is a perspective view of a power cord plug securing device according to a preferred embodiment of the present invention, shown in use.

Referring now to FIGS. 1-2, the present invention in a preferred embodiment is a power cord plug securing device 10 possessing securing strap 20 preferably integrally formed with clasp member 40. Preferably, device 10, in general, is formed from a durable plastic, or other suitable electrically non-conductive material, such as, for exemplary purposes only, rubber, polypropylene, polyethylene, polyurethane, suitable ployolefins, ethylene-vinyl-acetate substrates, combinations thereof, and/or the like. Although securing strap 20 is preferably integrally formed with clasp member 40, it is contemplated that securing strap 20 and clasp member 40 could be separately formed, and thereafter secured to one another via any suitable securing means known within the art, such as, for exemplary purposes only, hot melts, glues, epoxies, resins, permanent snap-fit mechanisms, rivets, fasteners, and/or the like.

Preferably, clasp member 20 is integrally formed with end 22 of securing strap 20. Additionally, throughhole 26 is preferably located proximal to and formed through opposing end 24 of securing strap 20. As best illustrated in FIG. 2, throughhole 26 is preferably adapted to receive conventional outlet cover plate screw S for securing device 10 to outlet cover plate CP. Preferably, securing strap 20 possesses a sufficient length to permit clasp member 40 to securely engage the portion of power cord PC located immediately aft of plug head PH, when the electrical prongs or conductors of plug head PH are electrically engaged with electrical outlet socket ES of outlet cover plate CP, as best illustrated in FIG. 2.

Preferably, clasp member 40 is substantially U-shaped, possessing trough region 42 with retaining walls 44, 46 extending therefrom, wherein retaining walls 44, 46 preferably terminate in inwardly projecting ends 48, 50, respectively. Collaboratively, trough region 42, retaining walls 44, 46, and ends 48, 50, yield a functionally contoured clasp member 40 adapted to engage and retain power cord PC therewithin.

Figure 2A:
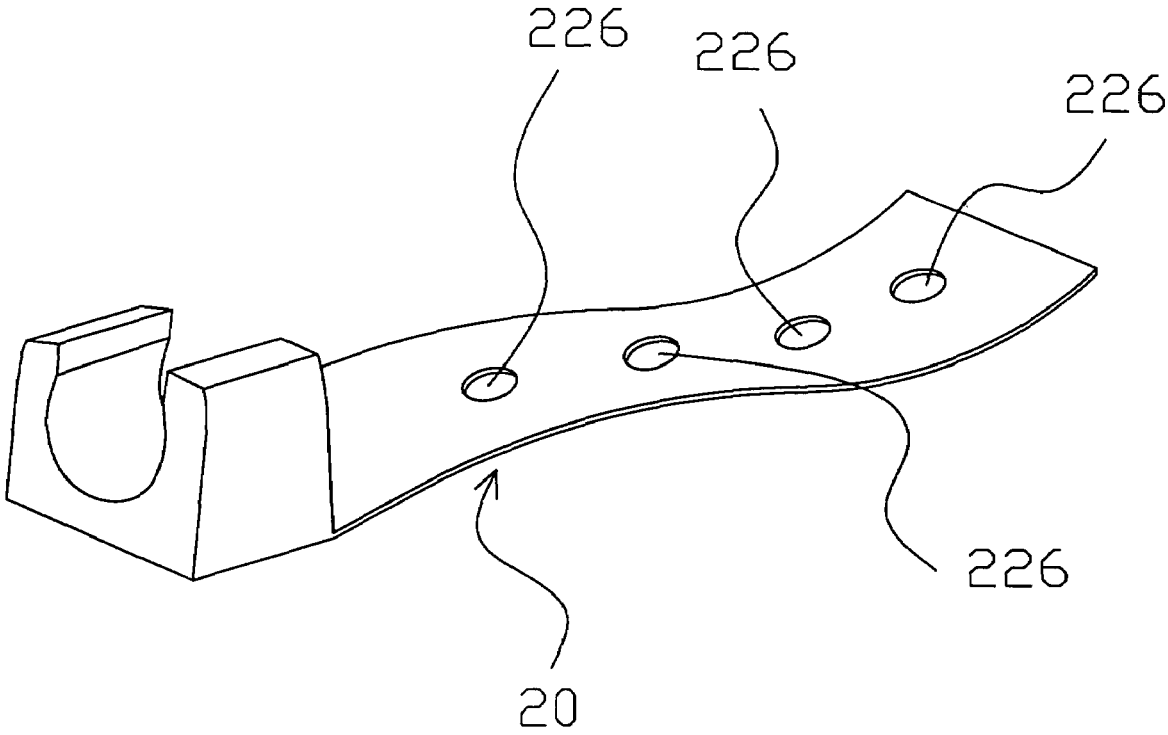
FIG. 2A is a perspective view of a power cord plug securing device according to an alternate embodiment of the present invention.

As best illustrated in FIG. 2A, although securing strap 20 preferably possesses throughhole 26 alone, it is contemplated in an alternate embodiment that securing strap 20 could possess a plurality of throughholes 226 for purposes of selectively determining site of engagement of screw S therewith, and, thus, the site of engagement of clasp member 40 on power cord PC, as the useful length of securing strap 20 is effected accordingly.

Figure 2B:
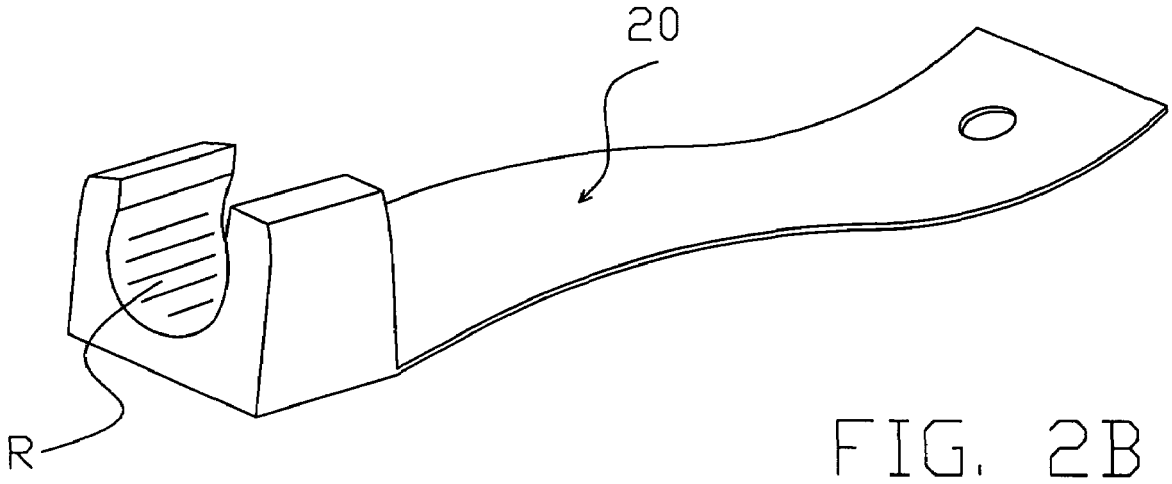
FIG. 2B is a perspective view of a power cord plug securing device according to an alternate embodiment of the present invention.

Additionally, and as best illustrated in FIG. 2B, it is contemplated in another alternate embodiment that trough region 42, retaining walls 44, 46, and ends 48, 50 of clasp member 40 could be at least partially textured or ribbed R for increased frictional association with a power cord PC retained therein.

Figure 3:
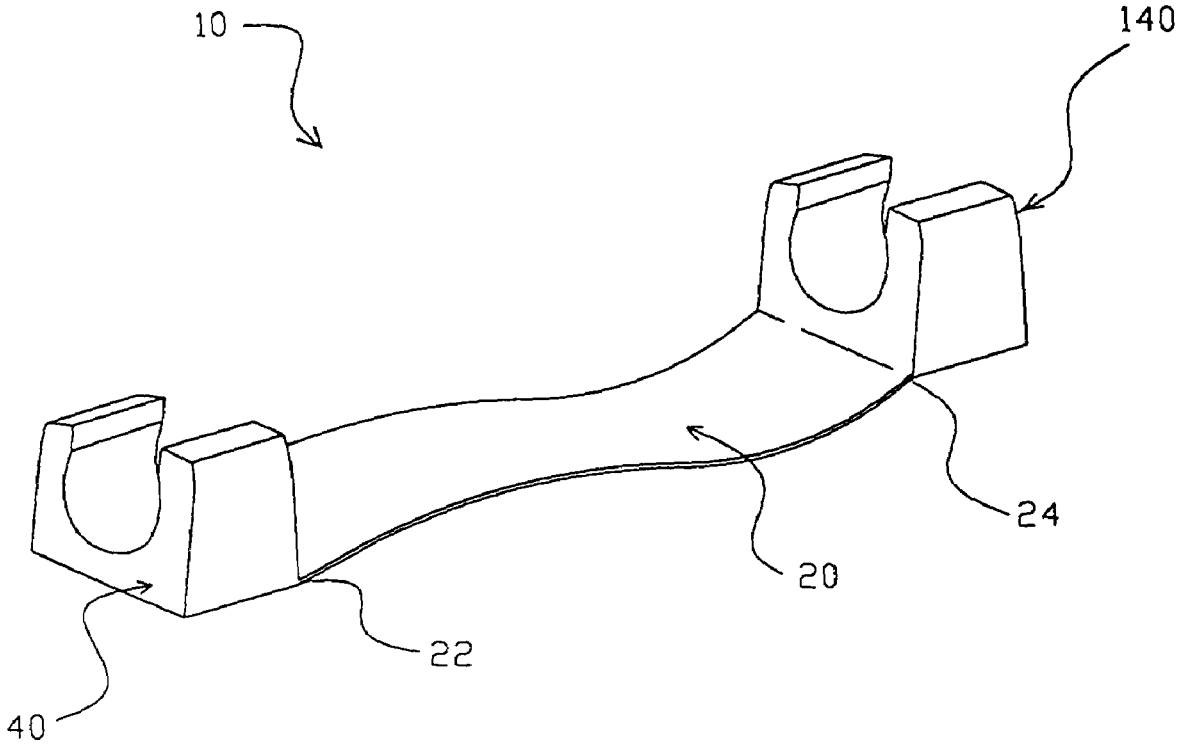
FIG. 3 is a perspective view of a power cord plug securing device according to an alternate embodiment of the present invention.
Figure 4:
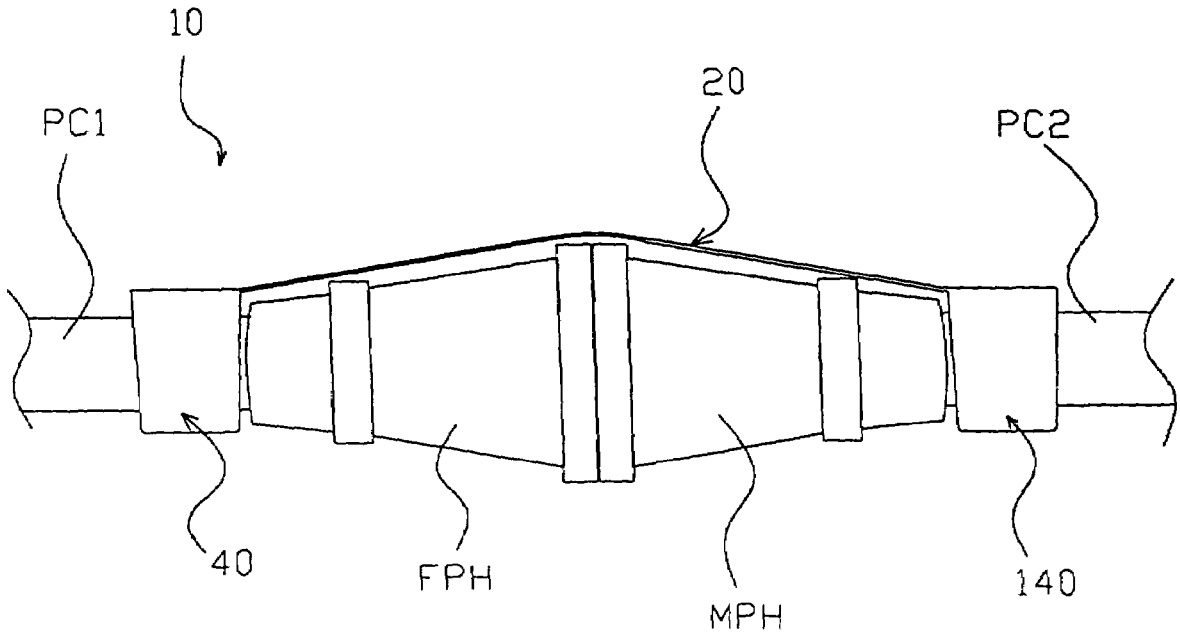
FIG. 4 is a perspective view of a power cord plug securing device according to an alternate embodiment of the present invention, shown in use.

Referring now more specifically to FIGS. 3-4, illustrated therein is an alternate embodiment of device 10, wherein the alternate embodiment of FIGS. 3-4 is substantially equivalent in form and function to that of the preferred embodiment detailed and illustrated in FIGS. 1-2 except as hereinafter specifically referenced. Specifically, the embodiment of FIGS. 3-4 incorporates an additional clasp member 140 at end 24 of securing strap 20, and dispenses with throughhole 26. As best illustrated in FIG. 4, the present alternate embodiment is particularly applicable in sustaining electrical engagement of a female plug head FPH of an extension cord or first power cord PC1, with male plug head MPH of a second power cord PC2, such as that from an appliance, or the like. Accordingly, securing strap 20 of the present alternate embodiment possesses a sufficient length to permit clasp members 40, 140 to securely engage the portion of power cords PC1, PC2, respectively, located immediately aft of female plug head FPH and male plug head MPH, respectively, when female plug head FPH and male plug head MPH are electrically engaged to one another, as best illustrated in FIG. 4.

Figure 5:
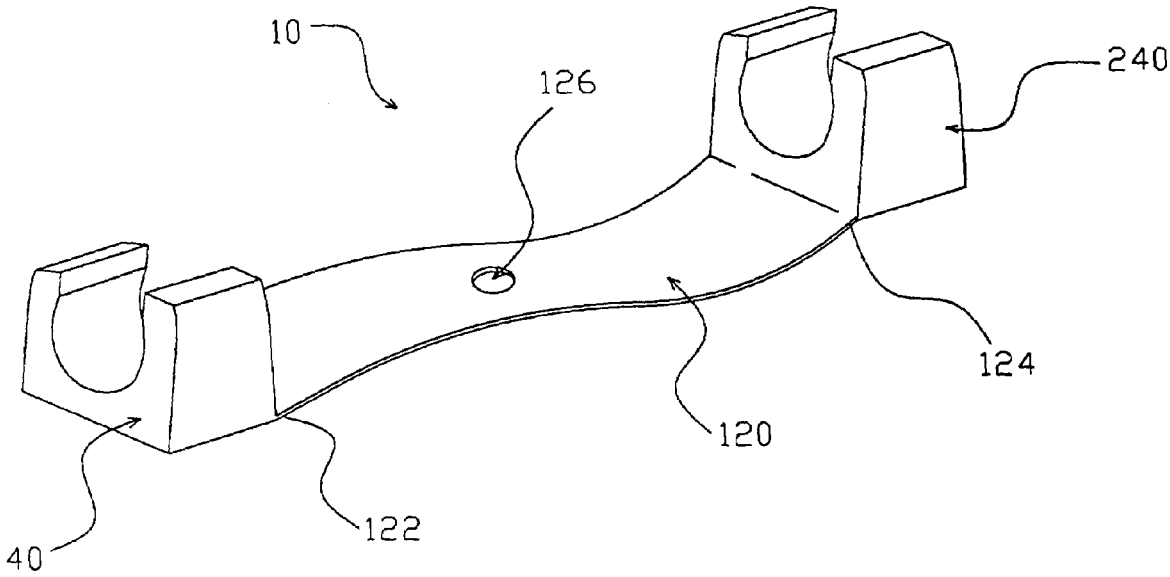
FIG. 5 is a perspective view of a power cord plug securing device according to an alternate embodiment of the present invention; and, FIG. 6 is a perspective view of a power cord plug securing device according to an alternate embodiment of the present invention, shown in use.
Figure 6:
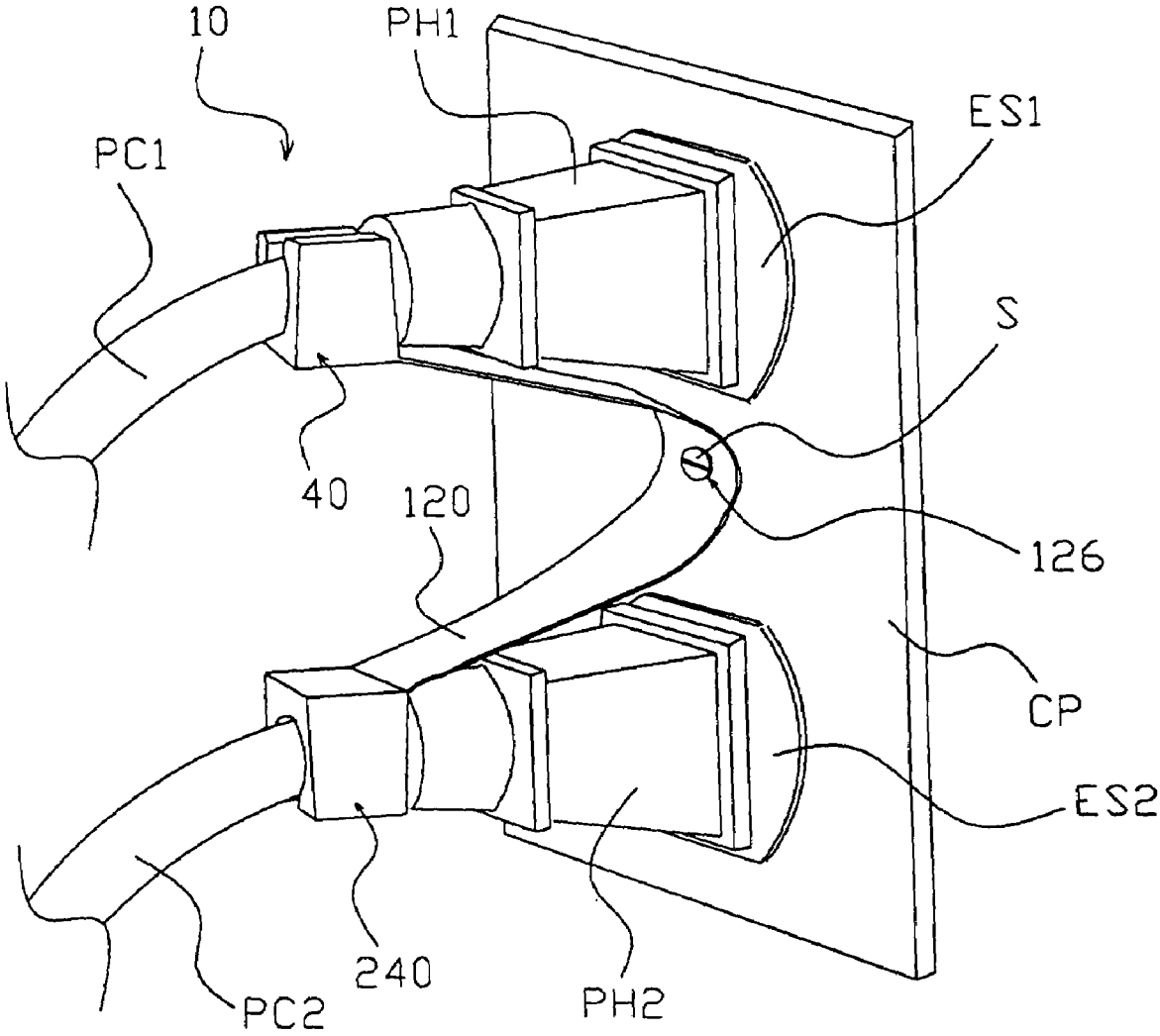

Referring now more specifically to FIGS. 5-6, illustrated therein is an alternate embodiment of device 10, wherein the alternate embodiment of FIGS. 5-6 is substantially equivalent in form and function to that of the preferred embodiment detailed and illustrated in FIGS. 1-2 except as hereinafter specifically referenced. Specifically, the embodiment of FIGS. 5-6 incorporates an additional clasp member 240 at end 124 of elongated securing strap 120, and replaces throughhole 26 with throughhole 126, centrally disposed on elongated securing strap 120. As best illustrated in FIG. 6, throughhole 126 is adapted to receive screw S of conventional outlet cover plate CP for securing alternate device 10 thereto. As such, clasp member 40 is able to securely engage a first power cord PC1 engaged with first electrical socket ES1, and clasp member 240 is able to securely engage a second power cord PC2 engaged with second electrical socket ES2. Additionally, securing strap 120 of the present alternate embodiment possesses a sufficient length to permit clasp members 40, 240 to securely engage the portion of power cords PC1, PC2, respectively, located immediately aft of first plug head PH1 and second plug head PH2, respectively, when first plug head PHI and second plug head PH2 are electrically engaged with electrical sockets ES1, ES2, respectively, as best illustrated in FIG. 6.

Although FIGS. 2, 4, and 6 depict utilization of device 10 on standard power cords, it is contemplated that device 10 could be utilized on any type of plug wire or cord-type current carrying member, such as, for exemplary purposes only, indoor/outdoor plug wires, industrial plugs, appliance plugs, telephone/local area network (LAN)/wide area network (WAN) plug wires, cable wires, data cables, coaxial cables, and/or the like, without limitation. Additionally, it is contemplated that device 10 could be utilized to retain the electrical prongs or conductors of any cord-type current carrying member in electrical engagement with any corresponding electrically conductive outlet or other suitable current carrying member, such as, for exemplary purposes only, standard indoor/outdoor electrical outlets, industrial outlets, appliance outlets, telephone/LAN/WAN outlets, cable outlets, data outlets, coaxial cable outlets, and the like.

It is contemplated in an alternate embodiment that clasp members 40, 140 and/or 240, and securing straps 20 and/or 120 of device 10, of the respective preferred or alternate forms, could be selectively manufactured to any desired size and/or from any desired material.

It is contemplated in an alternate embodiment that device 10, of either the preferred or alternate forms, could be manufactured to any desired size and/or from any desired material.

Figure 7:
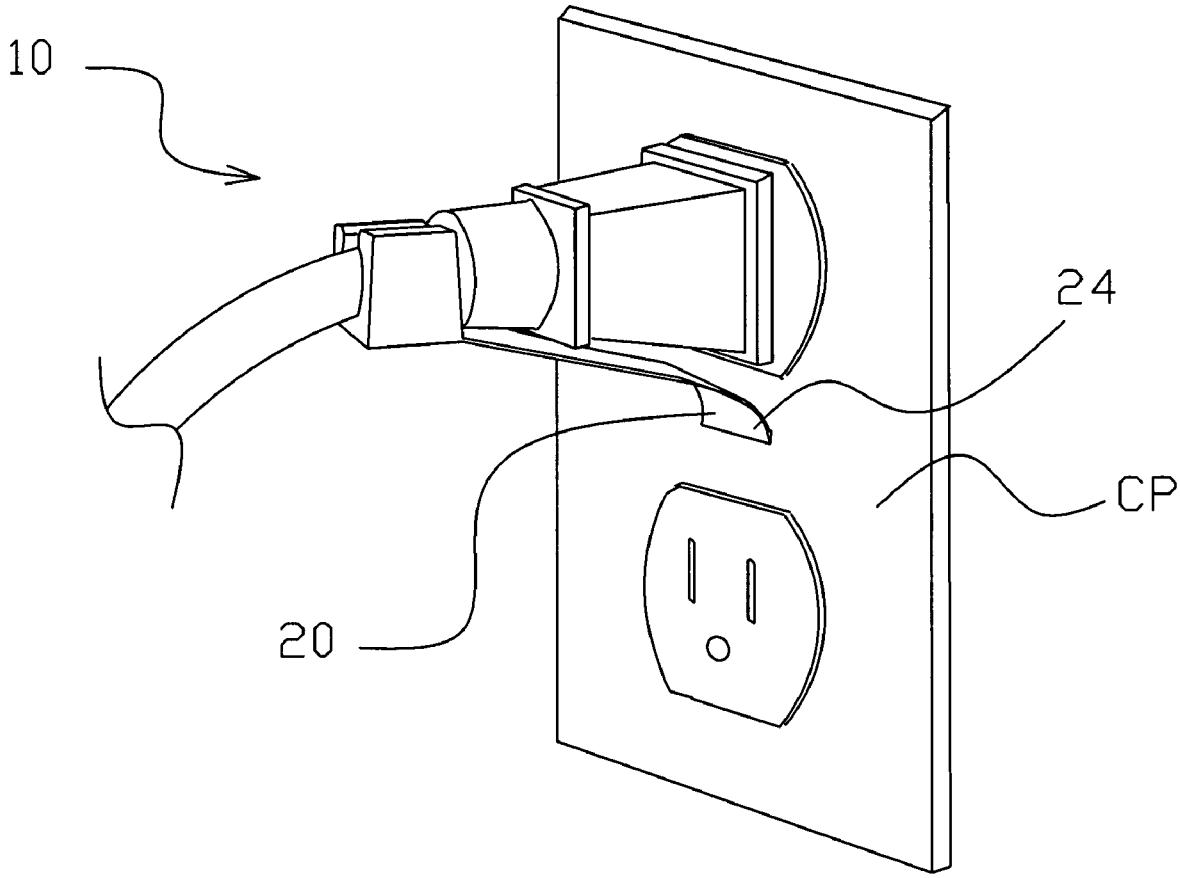
FIG. 7 is a perspective view of a power cord plug securing device according to an alternate embodiment of the present invention, shown in use.

As best illustrated in FIG. 7, it is contemplated in an alternate embodiment that opposing end 24 of securing strap 20 of device 10, and/or device 10 of either the preferred or alternate forms, could be integrally formed with a conventional cover plate CP.

It is contemplated in an alternate embodiment that device 10, of either the preferred or alternate forms, could be integrally formed with a plug head and/or plug cord.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

What is claimed is:

1. A power cord plug securing device, comprising:

an essentially inflexible clasp block member for removably and securably retaining a power cord therein, said clasp block member comprising a trough region disposed approximately centrally therethrough, said trough region disposed along a first axis of orientation corresponding with an axis of the power cord;

said trough region comprising a truncated cylindrical bottom portion and approximately vertically disposed retaining walls thereabove, said clasp block member further comprising an open region disposed approximately opposite said cylindrical bottom portion and centrally between said retaining walls, said open region forming an elongated channel to allow the power cord to traverse into and be captured within said cylindrical bottom portion;

a securing strap extending proximate from a base region of said clasp block member underlying said trough region and disposed along an axis of orientation parallel to said first axis of orientation, said securing strap oriented for underlying the power cord plug when in use; and, a throughhole formed through said securing strap, said throughhole adapted to receive an electrical outlet cover plate screw for removable attachment of said device to an electrical outlet cover plate, thereby maintaining electrical engagement of electrical conductors of a plug head of the power cord with an electrical outlet.

2. The device of claim 1, wherein said clasp block member is adapted to removably engage and securely retain a portion of the power cord immediately aft of the plug head when attached thereto.

3. The device of claim 2, wherein said clasp block member is substantially U-shaped.

4. The device of claim 2, wherein said retaining walls terminate in inwardly projecting ends for securely maintaining the portion of the power cord immediately aft of the plug head within said trough region.

5. The device of claim 4, wherein at least one of said trough region and said retaining walls are at least partially textured or ribbed for increased frictional association with the portion of the power cord retained therein.

6. The device of claim 1, wherein a first end of said securing strap is integrally formed with said clasp member.

7. The device of claim 6, wherein a second end of said securing strap is integrally formed with the electrical outlet cover plate.

8. The device of claim 1, wherein said throughhole is opposingly positioned from said clasp member on said securing strap.

9. The device of claim 1, further comprising a plurality of throughholes formed through said securing strap for purposes of selectively determining site of engagement of the screw therewith, and, thus, the site of engagement of said clasp member on the power cord.

10. A power cord plug securing device, comprising:

a first essentially inflexible clasp block member for removably and securably retaining a first power cord therein, said first clasp block member comprising a trough region disposed approximately centrally therethrough, said trough region disposed along a first axis of orientation corresponding with an axis of the first power cord;

a second essentially inflexible clasp block member for removably and securably retaining a second power cord therein, said second clasp block member comprising a trough region disposed approximately centrally therethrough, said trough region of said second clasp block member disposed along an axis of orientation parallel to said first axis of orientation;

each of said trough regions comprising a truncated cylindrical bottom portion and approximately vertically disposed retaining walls thereabove, each of said clasp block members further comprising an open region disposed approximately opposite said cylindrical bottom portion and centrally between said retaining walls, said open region forming an elongated channel to allow a power cord to traverse into and be captured within said cylindrical bottom portion; and, a securing strap extending between a base region underlying said trough region of said first clasp block member and a base region underlying said trough region of said second clasp block member, wherein said securing strap is disposed along an axis of orientation parallel to said first axis of orientation, said securing strap oriented for underlying the power cord plugs when in use.

11. The device of claim 10, wherein said plug securing device is adapted to maintain the first power cord in electrical engagement with the second power cord.

12. The device of claim 10, further comprising a throughhole formed through said securing strap, said throughhole adapted to receive an electrical outlet cover plate screw for removable attachment of said device to an electrical outlet cover plate.

13. The device of claim 12, wherein at least one of said first and second clasp members is adapted to maintain electrical engagement of a plug head of at least one of the first and second power cords with an electrical outlet.

14. The device of claim 10, wherein said first clasp member is adapted to removably engage and securely retain a portion of the first power cord immediately aft of a plug head attached thereto, and wherein said second clasp member is adapted to removably engage and securely retain a portion of the second power cord immediately aft of a plug head attached thereto.

15. The device of claim 14, wherein said first and second clasp members are substantially U-shaped.

16. The device of claim 14, wherein said retaining walls terminate in inwardly projecting ends for securely maintaining the portions of the respective first and second power cords immediately aft of the plug heads within each said trough region.

17. The device of claim 16, wherein at least one of said trough regions and said retaining walls are at least partially textured or ribbed for increased frictional association with the portions of the respective first and second power cords retained therein.

18. A method of maintaining electrical continuity between at least a first and second current carrying member, said method comprising the steps of:

a. obtaining a device having an essentially inflexible clasp block member for removably and securably retaining the first current carrying member therein, said clasp block member comprising a trough region disposed approximately centrally therethrough, said trough region disposed along a first axis of orientation corresponding with an axis of the first current carrying member, said trough region comprising a truncated cylindrical bottom portion and approximately vertically disposed retaining walls thereabove, said clasp block member further comprising an open region disposed approximately opposite said cylindrical bottom portion and centrally between said retaining walls, said open region forming an elongated channel to allow a current carrying member to traverse into and be captured within said cylindrical bottom portion, wherein said clasp block member comprises a securing strap extending proximate from a base region of said clasp block member underlying said trough region and disposed along an axis of orientation parallel to said first axis of orientation, said securing strap oriented for underlying a plug of the current carrying member when in use;

b. securing within said clasp block member a portion of the first current carrying member; and, c. securing the first current carrying member to the second current carrying member via a means for securing carried by said securing strap.

19. The method of claim 18, wherein the first current carrying member is a first cord-type current canying member, and wherein the second current carrying member is selected from the group consisting of a second cord-type current carrying member, and an electrical outlet.

20. The method of claim 19, wherein said securing means is a throughhole formed through said securing strap, said throughhole adapted to receive an electrical outlet cover plate screw for removable attachment of said device to an electrical outlet cover plate for maintaining the first cord-type current carrying member in electrical continuity with the electrical outlet.

21. The method of claim 19, wherein said securing means is a second clasp member carried by said securing strap, said second clasp member adapted to removably and securably engage a portion of the second cord-type current carrying member.

22. The method of claim 21, wherein said device is adapted to maintain electrical engagement between the first cord-type current carrying member and the second cord-type current carrying member.

23. The method of claim 18, wherein said securing strap further comprises a throughhole formed therethrough, said throughhole adapted to receive an electrical outlet cover plate screw for removable attachment of said device to an electrical outlet cover plate for maintaining a first cord-type current carrying member and a second cord-type current carrying member in electrical continuity with an electrical outlet.

* * * * *